US006270197B1

(12) United States Patent
Ahn et al.

(10) Patent No.: US 6,270,197 B1
(45) Date of Patent: Aug. 7, 2001

(54) MICRO-INJECTING DEVICE HAVING A MEMBRANE HAVING AN ORGANIC LAYER AND A METALLIC LAYER AND METHOD FOR MANUFACTURING THE SAME

(75) Inventors: Byung-sun Ahn, Suwon (KR); Zukovandrey Aleksandrovich; Dunaev Boris Nikolaevich, both of Moscow (RU)

(73) Assignee: Samsung Electronics, Co., Ltd., Suwon (KR)

( * ) Notice: Subject to any disclaimer, the term of this patent is extended or adjusted under 35 U.S.C. 154(b) by 0 days.

(21) Appl. No.: 09/432,411

(22) Filed: Nov. 2, 1999

(30) Foreign Application Priority Data

Nov. 3, 1998 (RU) ..... 98119890

(51) Int. Cl.[7] ..... B41J 2/05
(52) U.S. Cl. ..... 347/63; 347/67
(58) Field of Search ..... 347/63, 65, 68, 347/70, 67, 54

(56) References Cited

U.S. PATENT DOCUMENTS 4,480,259 * 10/1984 Kruger et al. ..... 347/63
4,490,728 12/1984 Vaught et al. ..... 347/60
4,809,428 3/1989 Aden et al. ..... 29/611
5,140,345 8/1992 Komuro ..... 347/64
5,274,400 12/1993 Johnson et al. ..... 347/43
5,420,627 5/1995 Keefe et al. ..... 347/87
6,120,134 * 9/2000 Lee ..... 347/54

* cited by examiner

*Primary Examiner*—John Barlow
*Assistant Examiner*—Juanita Stephens
(74) *Attorney, Agent, or Firm*—Robert E. Bushnell, Esq.

(57) ABSTRACT

A micro-injecting device and a method for manufacturing the device are disclosed in which a main operational part of a membrane is structured to have two regions: an impact film region having high expansion and contraction delivery characteristics, for example, a nickel film region, and an organic film region having high expansion and contraction, for example, a polyimide film region. Each of the two regions serves as an impact delivery medium for efficiently pushing ink upward, a prompt initialization medium, and a hinge for dispersing and eliminating a stress, to thereby prevent deformation, for example, wrinkling, of the a membrane. In addition, a membrane having such enhanced main operation part can endure stress and react well during operation. As a result, significantly enhanced injecting performance can be obtained.

18 Claims, 8 Drawing Sheets

MICRO-INJECTING DEVICE HAVING A MEMBRANE HAVING AN ORGANIC LAYER AND A METALLIC LAYER AND METHOD FOR MANUFACTURING THE SAME

CLAIM OF PRIORITY

This application makes reference to, incorporates the same herein, and claims all benefits accruing under 35 U.S.C. §119 from an application for MICRO INJECTING DEVICE AND METHOD FOR MANUFACTURING THE SAME earlier filed in the Russian Federation Patent Office on the Nov. 3, 1998 and there duly assigned Ser. No. 98119890.

BACKGROUND OF THE INVENTION

1. Field of the Invention ask The present invention relates to the field of micro-injecting devices and inkjet printheads, and more particularly, to membrane-containing micro-injecting devices. The present invention also relates to a method for manufacturing such micro-injecting devices.

2. Description of the Related Art

Generally, a micro-injecting device refers to a device which is designed to provide printing paper, a human body or motor vehicles with a predetermined amount of liquid, for example, ink, pharmaceutical liquid or petroleum using the method in which a predetermined amount of electric or thermal energy is applied to the abovementioned liquid, yielding a volumetric transformation of the liquid. This method allows the application of a small quantity of a liquid to a specific object.

Recently, developments in electrical and electronic technology have enabled rapid development of such micro-injecting devices. Thus, micro-injecting devices are being widely used in daily life. One example of the use of micro-injecting devices in daily life is the inkjet printer.

The inkjet printer is a form of micro-injecting device which differs from conventional dot printers in the capability of performing print jobs in various colors by using cartridges. Additional advantages of inkjet printers over dot printers are lower noise and enhanced quality of printing. For these reasons, inkjet printers are gaining immensely in popularity.

An inkjet printer generally includes a printer head having nozzles with a minute diameter. In such an inkjet printhead, the ink which is initially in the liquid state is transformed and expanded to a bubble state by turning on or off an electric signal applied from an external device. Then, the ink so bubbled is injected so as to perform a print job on a printing paper.

Examples of the construction and operation of several ink jet print heads of the conventional art are seen in the following U.S. Pat. U.S. Pat. No. 4,490,728, to Vaught et al., entitled Thermal Ink Jet Printer, describes a basic print head. U.S. Pat. No. 4,809,428, to Aden et aL, entitled Thin Film Device For An Ink Jet Printhead and Process For Manufacturing Same and U.S. Pat. No. 5,140,345, to Komuro, entitled Method Of Manufacturing a Substrate For A Liquid Jet Recording Head And Substrate Manufactured By The Method, describe manufacturing methods for inkjet printheads. U.S. Pat. No. 5,274,400, to Johnson et al, entitled Ink Path Geometry For High Temperature Operation Of Ink-Jet Printheads, describes altering the dimensions of the ink-jet feed channel to provide fluidic drag. U.S. Pat. No. 5,420,627, to Keefe et al, entitled Ink Jet Printhead, shows a particular printhead design.

In such a conventional inkjet printhead, a high temperature which is generated by a heating resistor layer is employed so as to eject ink. Here, if the ink contained in a liquid chamber is exposed to high temperature for a considerable time, thermal changes in the constituent parts of the ink may significantly reduce the lifespan of the device.

Recently, to overcome the above-mentioned problem, there has been proposed a method in which a substrate-shaped membrane is inserted between a heating resistor layer and a liquid chamber, and a transformation in volume of membrane is caused by the vapor pressure of a working liquid that fills a heating chamber. Thus, the ink contained in the liquid chamber is smoothly discharged.

In this case, direct contact between the ink and heating resistor layer can be avoided, since a membrane is inserted between the liquid chamber and the heating resistor layer. Thus, thermal changes in the ink can be minimized. An example of this type of printhead is seen in U.S. Pat. 4,480,259, to Kruger et at, entitled Ink Jet Printer With Bubble Driven Flexible Membrane.

In the above-described membrane-containing inkjet printhead, a membrane is expanded and contracted by a vapor pressure delivered from working liquid contained in a heating chamber, and is thus transformed in volume. Subsequently, an impact having a predetermined size is delivered to ink contained in a liquid chamber so that the ink can be ejected to external printing paper. Here, the above-described transformation in volume of the membrane occurs simultaneously all over the membrane.

Because the membrane is frequently transformed in volume during operation, if the membrane is made of nickel due to the impact delivery or operational resilience (that is, the restoring force to the original state) characteristics of nickel a weak part of the membrane may be In particular, this may occur in the portion of the membrane not supported by the structure of the heating chamber.

Moreover, the part which is not supported by the structure of the heating chamber, mentioned above, is a main operational part of the membrane which pushes ink upward. Therefore, if wrinkling occurs in such a main operational part, the mechanical characteristics of the membrane are significantly reduced.

On the other hand, if a membrane is made of polyimide, for example, in consideration of the stress or adhesion (to the heating chamber or liquid chamber) characteristics of this material, then the main operational part of the membrane is capable of remaining ductile and can endure deformation, for example, wrinkling, to some extent. However, the impact delivery characteristics and operational resilience are extremely weak for polyimide. Thus, the main part of the membrane cannot rapidly respond to generation of vapor pressure from the heating chamber, thereby disturbing the smooth operation of ink ejection.

Thus, the overall printing performance of the inkjet printhead is significantly lowered.

SUMMARY OF THE INVENTION

It is therefore an object of the present invention to provide an improved micro-injecting device.

It is a further object of the invention to provide a micro-injecting device with improved injection performance.

It is a still further object of the invention to provide a micro-injecting device in which damage to the membrane is avoided.

It is a yet further object of the invention to provide a micro-injecting device in which the mechanical characteristics of the membrane are improved.

To achieve the above objects and other advantages of the present invention, the main operational part of a membrane is structured to have two regions: an impact film region having high impact delivery and operational resilience characteristics, for example, a nickel film region; and an organic film region having high expansion and contraction characteristics, for example, a polyimide film region. The above two regions serve as an impact delivery medium for strongly pushing up ink, a rapid initialization medium, and a binge for dispersing and eliminating stress, to thereby prevent wrinkling of the membrane. In addition, a membrane having such an enhanced main operational part can endure stress and react well during operation As a result, a significantly enhanced injecting performance can be obtained.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
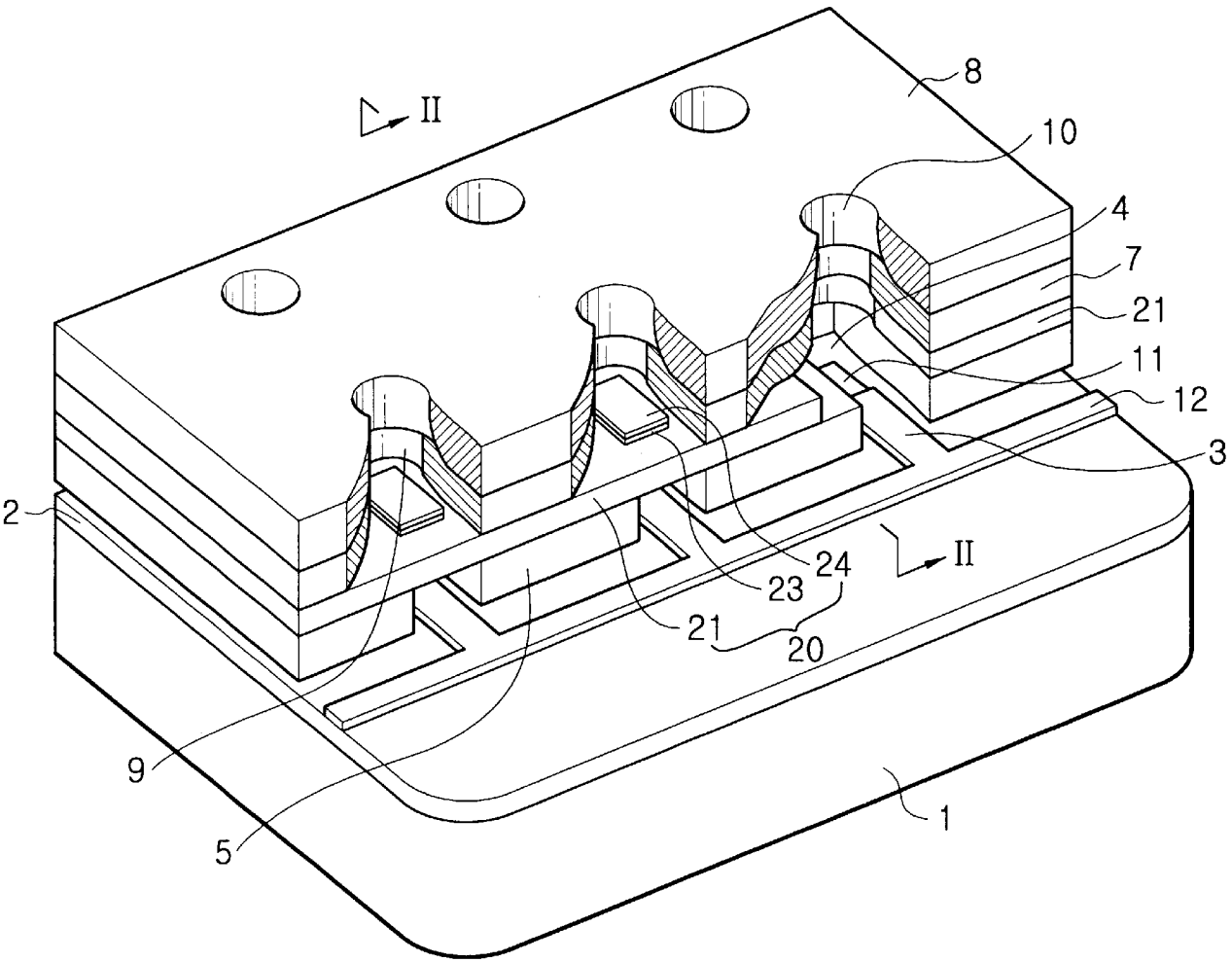
FIG. 1 is a perspective view showing an inkjet printhead of a first embodiment of the present invention.
Figure 2:
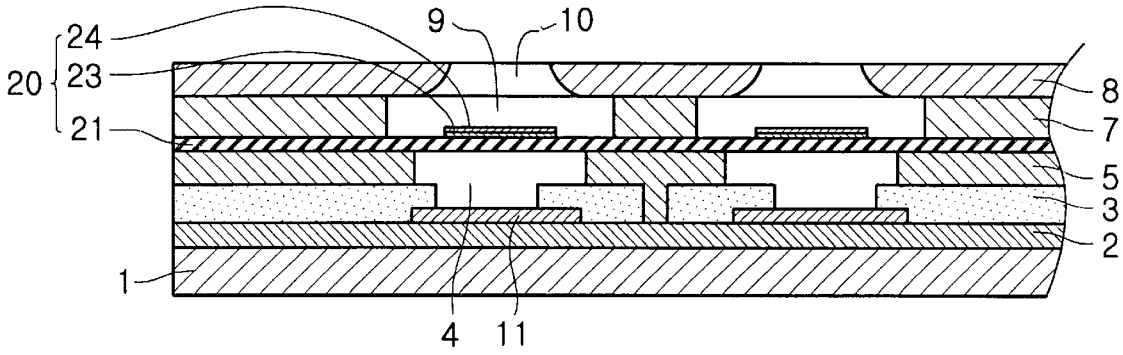
FIG. 2 is a cross-sectional view of an inkjet printhead taken along II—II in FIG. 1.

The present invention now will be described more filly hereinafter with reference to the accompanying drawings, in which preferred embodiments of the invention are shown. As shown in FIGS. 1 and 2, in an inkjet printhead of the present invention, a protection film 2 made of $SiO_2$ is formed on a substrate 1 made of Si, and a heating resistor layer 11 to be heated by electric energy applied from an external device is formed on the protection film 2, and an electrode layer 3 for supplying the electric energy applied from an external device to the heating resistor layer is formed on the heating resistor layer 11. The electrode layer 3 is connected to a common electrode 12, and the electric energy supplied from the electrode layer 3 is converted to thermal energy by the heating resistor layer 11.

Meanwhile, a heating chamber 4 bordered by a heating chamber barrier layer 5 is formed on the electrode layer 3 so as to cover the heating resistor layer 11; the thermal energy converted by the heating resistor layer 11 is delivered to the heating chamber 4. The heating chamber 4 is filled with working liquid from which a vapor pressure is easily generated. In operation, the working liquid is rapidly vaporized by the thermal energy delivered from the heating resistor layer 11. In addition, the vapor pressure generated by the vaporization of the working liquid is delivered to a membrane 20 formed on the heating chamber barrier layer 5.

Then, a liquid chamber 9 bordered by a liquid chamber barrier layer 7 and positioned coaxially with the heating chamber layer 4 is formed on the membrane 20 and is filled with a relevant amount of ink. Here, a nozzle 10 is formed on the liquid chamber barrier layer 7 so as to cover the liquid chamber 9 and serves as a jet gate for ink droplet discharge. The nozzle 10 is formed penetrating through a nozzle plate 8 so as to be positioned coaxially with the heating chamber 4 and liquid chamber 9.

In the above described structure, the membrane 20 has a deposited layered structure in which an organic film 21 is formed over the entire heating chamber barrier layer 5 so as to cover the heating chamber 4, an adhesion film 23 to be positioned coaxially with the heating chamber 4 is formed on the organic film 21 so as to correspond to a region where the heating chamber 4 is formed, and an impact film 24 is formed on the adhesion film 23. That is, the impact film 24 is positioned in a main operational part of the membrane 20, corresponding to the position of heating chamber 4. The organic film 21 to which the impact film 24 adheres forms the lower portion of the membrane 20.

During operation, the impact film 24 is rapidly transformed in volume and serves to deliver a strong impact to ink contained in the liquid chamber 9 formed thereon. At the same time, the organic film 21 is rapidly transformed in volume with excellent expansion and contraction characteristics, to thereby disperse and remove stress on the impact film 24.

Preferably, the organic film 21 is made of a polyimide having excellent expansion, contraction and ductility. Here, the organic film 21 adheres to the liquid chamber barrier layer 7 formed on the membrane 20. In general, the liquid chamber barrier layer 7 is made of polyimide having a strong tolerance to ink. As described above, the organic film 21 is made of the same polyimide as that of liquid chamber banier layer 7. Therefore, a strong adhesion between the organic film 21 and the liquid chamber barrier layer 7 can be obtained.

Preferably, the impact film 24 is made of nickel having excellent restoring force characteristics. Thus, the impact film 24 made of nickel rapidly reacts to the vapor pressure generated by a vaporization of working liquid, and is thus rapidly transformed in volume. Then, ink contained in the liquid chamber 9 can be promptly expelled toward the nozzle 10.

The adhesion film 23 for promoting an adhesive force is formed between the organic film 21 and the impact film 24.

Thus, the organic film 21 and the impact film 24, which are made of different materials, can adhere strongly to each other. Preferably, the adhesion film 23 is made of vanadium, titanium, or chromium.

In the prior art, if the membrane is made of nickel, wrinkling has occurred in a main operation part of the membrane, thereby significantly lowering mechanical characteristics of the membrane. On the other hand, if the membrane is made of polyimide, a man operation part of the membrane cannot rapidly react to a vapor pressure generated from a heating chamber, thereby lowering significantly the overall printing performance.

Figure 3:
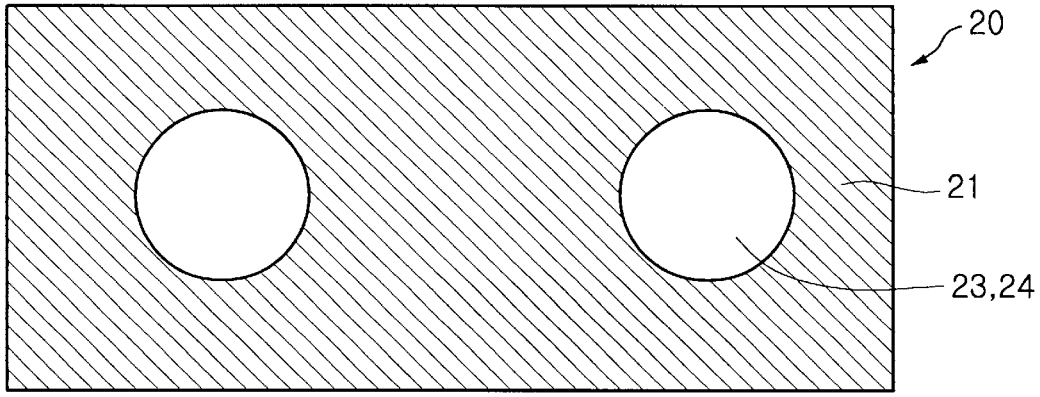
FIG. 3 is a plan view of a membrane according to the first embodiment of the present invention.

To overcome these problems, in the present invention, both nickel and polyimide are employed for a main operational part of the membrane 20. That is, as shown in FIG. 3, the impact film 24 having an excellent restoring force is formed in the main operational part of the membrane 20, and subsequently the organic film 21 having excellent ductility is formed in the lower portion of the membrane 20. In this manner, stress in the impact film 24, generated by a vapor pressure of the heating chamber 4, is delivered to the organic film 21 which has excellent expansion and contraction, and the stress is then dispersed and removed. Thus, the membrane 20 can rapidly react, without any wrinkling, to the vapor pressure of working liquid. As a result, overall printing quality is greatly enhanced.

Figure 4:
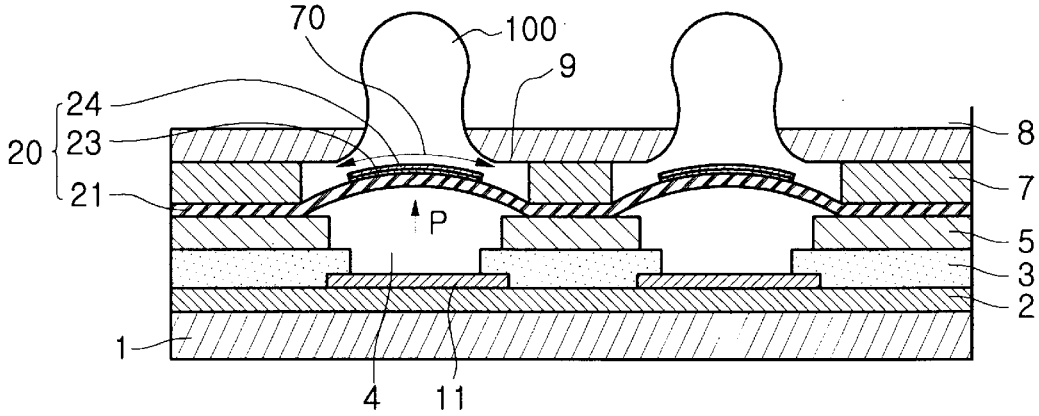
FIG. 4 is a cross-sectional view showing a first operation of an inkjet printhead of the first embodiment of the present invention.

As shown in FIG. 4, when an electric signal is applied to the electrode layer 3 from an external power source, the heating resistor layer 11 that contacts the electrode layer 3 is provided with the electric energy and thus is rapidly heated to a high temperature of 500° C. or higher. In this process, the electric energy is converted to a thermal energy of approximately 500° C. to 550° C.

Subsequently, this thermal energy is delivered to the heating chamber 4 that contacts the heating resistor layer 11. Then, the working liquid that fills the heating chamber 4 is rapidly vaporized so as to generate a vapor pressure having a predetermined size. Then, the vapor pressure is delivered to the membrane 20 on the heating chamber barrier layer 5, thus an impact power P having a predetermined size is applied to the membrane 20.

In this case, as shown in FIG. 4, the membrane 20 is rapidly expanded as indicated in arrow 70 and bent to a round shape. Accordingly, a strong impact is delivered to ink 100 contained in the liquid chamber 9, and the ink 100 is bubbled by the impact and ready to be discharged.

As described above, the membrane 20 of the present invention is made up of two regions, and includes the impact film 24 having an excellent impact delivery characteristic and the organic film 21 for dispersing and removing a stress on the impact film 24. Therefore, deformations which have occurred in a conventional membrane, for example, wrinkling, can be eliminated.

Figure 6:
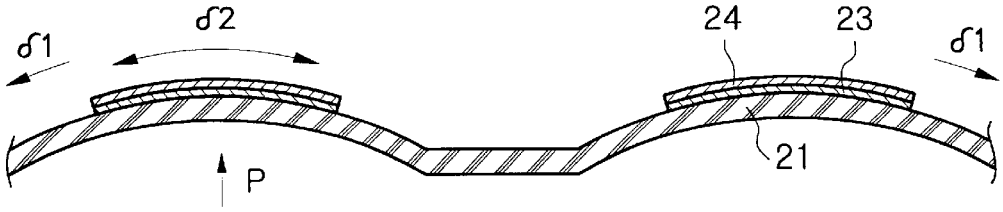
FIG. 6 is a cross-sectional view showing a first operation of a membrane according to the first embodiment of the present invention.

The impact film 24 made of nickel preferably has weight per unit area which is larger than that of the organic film 21 made of polyimide. Thus, as shown in FIG. 6, the impact film 24 is capable of delivering a strong impact to the ink contained in the liquid chamber 9 according to the equation $P=m\Delta V$ (where P is the impact, m is weight of the film, and $\Delta V$ is volume displaced by the film during expansion).

In addition, the organic film 21 is preferably made of polyimide which has better expansion and contraction characteristics than that of the impact film 24 made of nickel. As shown in FIG. 6, a stress $\delta 2$ on the impact film 24 can be absorbed into a stress $\delta 1$ so as to be dispersed and removed.

Figure 5:
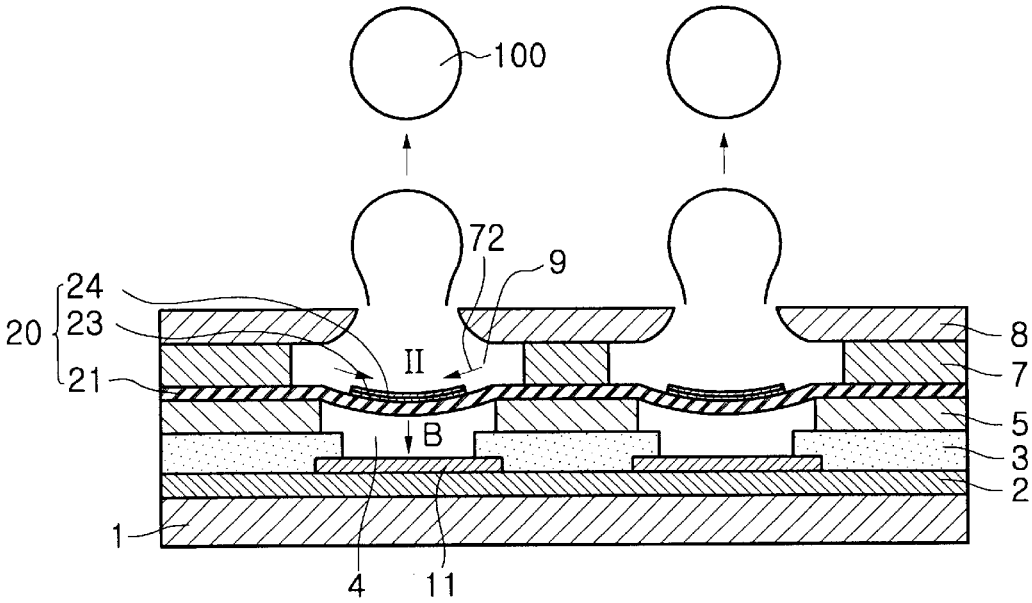
FIG. 5 is a cross-sectional view showing a second operation of an inkjet printhead of the first embodiment of the present invention.

When, as shown in FIG. 5, the electric signal applied from an external power source is cut off and the heating resistor layer 11 rapidly cools down, the vapor pressure in the heating chamber 4 rapidly decreases. Then, the inside of the heating chamber 4 rapidly becomes a vacuum Subsequently, the vacuum applies a strong buckling power B corresponding to the above-described impact to the membrane 20, to thereby contract the membrane 20 to the initial state.

As shown in FIG. 5, the membrane 20 is rapidly contracted in the direction indicated in arrows 72 so as to deliver a strong buckling power to the inside of the liquid chamber 4. Then, the ink 100 ready for expelled by the expansion of the membrane 20 is transformed, due to its own weight, to oval and then circular shapes in turn, and is ejected onto printing paper. As a result, a rapid print job is performed on the printing paper.

The membrane 20 of the present invention consists of the impact film 24 having excellent impact delivery characteristics, and the organic film 21 having excellent expansion and contraction characteristics for dispersing and removing stress on the impact film 24. Therefore, deformations, for example, wrinkling, which can occur in a conventional membrane can be prevented. In addition, the membrane 20 can be rapidly initialized toward the heating chamber 4 and an excellent operational reaction can be obtained.

Figure 7:
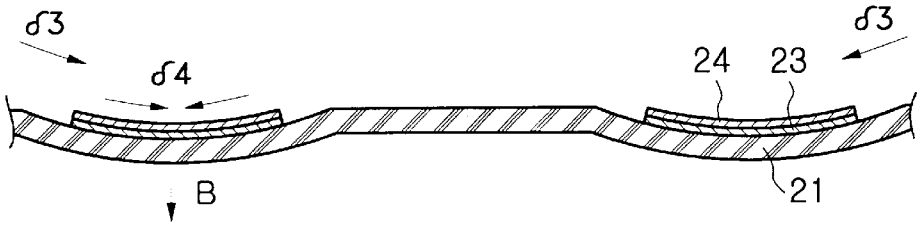
FIG. 7 is a cross-sectional view showing a second operation of a membrane according to the first embodiment of the present invention.

The organic film 21 made of polyimide has better expansion and contraction characteristics than that of the impact film 24 made of nickel As shown in FIG. 7, the organic film 21 makes a stress $\delta 4$ absorbed into a stress $\delta 3$ on the impact film 24 and disperses and remove this stress.

Figure 8:
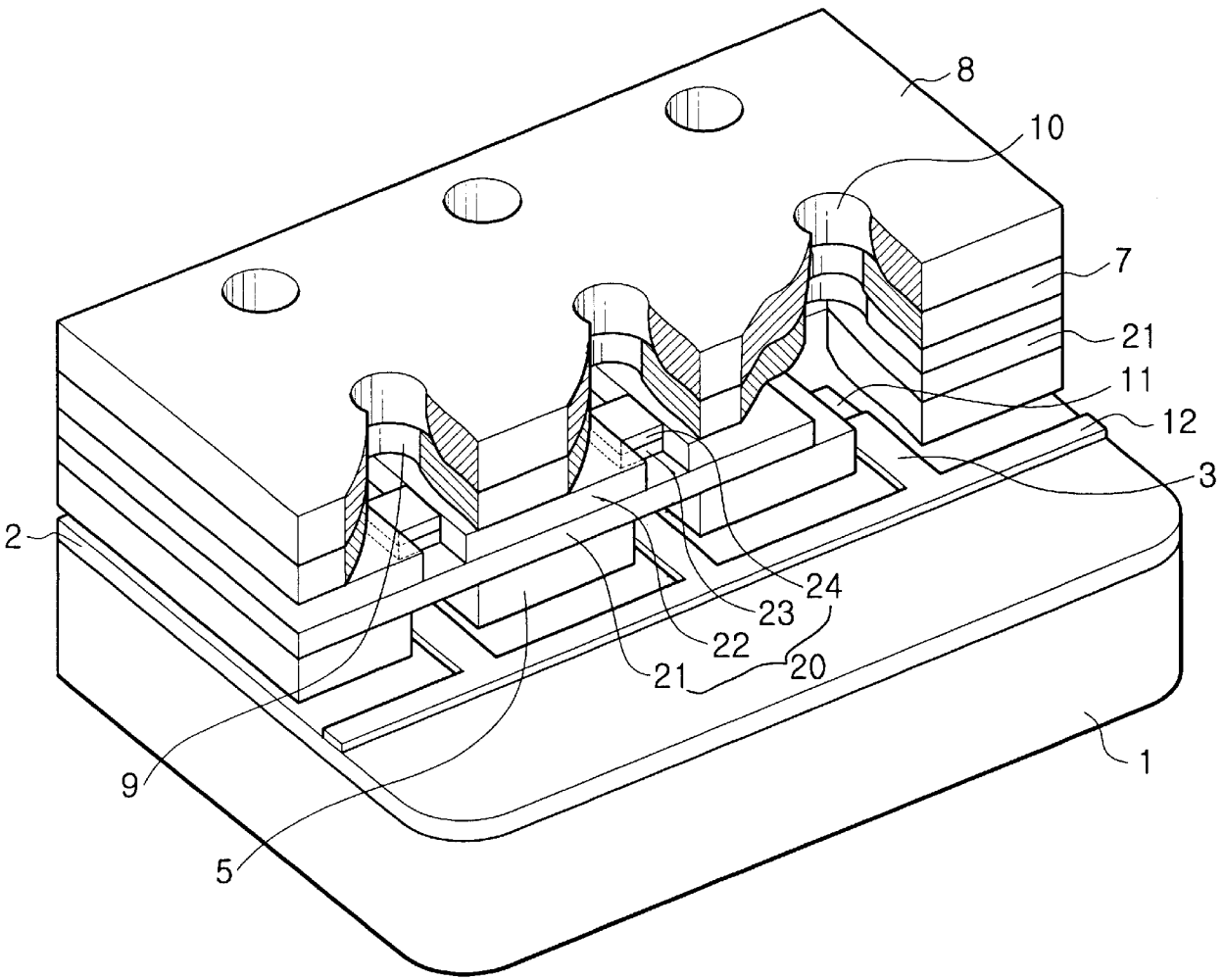
FIG. 8 is a perspective view showing an inkjet printhead according to a second embodiment of the present invention.

As shown in FIG. 8, in an inkjet printhead according to another embodiment of the present invention, an ailiary organic film 22 that contacts a side surface of the impact film 24 and which overlaps an upper edge of the heating chamber 4 is further formed on the organic film 21 of the membrane 20. In this case, the auxiliary organic film 22 serves to further strengthen expansion and contraction of the organic film 21. Therefore, the organic film 21 can remove more smoothly the stress on the impact film 24.

In this configuration of this embodiment, the auxiliary organic film 22 further formed on the organic film 21 adheres to the liquid chamber barrier layer 7 formed on the membrane 20. Here, like the organic film 21, the auxiliary organic film 22 is made of the same polyimide as that of the liquid chamber barrier layer 7. As a result, the auxiliary organic film 22 can be further strongly adhered to the liquid chamber barrier layer 7.

Now, a first method for manufacturing an inkjet printhead of the present invention will be explained in more detail. The first method consists of three independent processes. Parts manufactured through the three processes, for example, a heating resistor layer 11 and heating chamber barrier layer 5 assembly, membrane 20, and a nozzle plate 8 and liquid chamber barrier layer 7 assembly, etc., are assembled to each other at a relevant position through an alignment process which will be performed later. As a result, a complete inkjet printhead can be obtained.

Figure 9A:
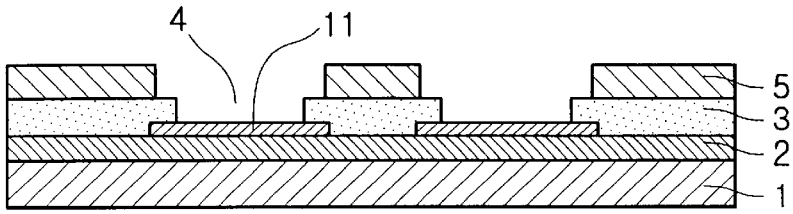
FIGS. 9*a* to 9*d* are cross-sectional views showing a process for manufacturing an inkjet printhead according to a third embodiment of the present invention.

At the first method, as a first process, as shown in FIG. 9*a*, metal, for example, polysilicon, is deposited on the silicon-substrate 1 on which the protection film 2 made of $SiO_2$ is formed. Subsequently, the polysilicon is etched using a pattern film (not shown) so that the protection film 2 can be partially exposed, thereby forming the heating resistor layer 11 on the protection film 2.

Metal, for example, aluminum, is then deposited on the protection film 2 so as to cover the heating resistor layer 11. Subsequently, the aluminum is etched using a pattern film so that a center surface of the heating resistor layer 11 can be exposed, thereby forming the electrode layer 3 which contacts both side surfaces of the heating resistor layer 11.

Then, organic material, for example, polyimide, is deposited on the electrode layer 3 so as to cover heating resistor layer 11. The polyimide is then etched using a pattern film so that a partial surface of the heating resistor layer 11 and the electrode layer 3 can be exposed, thereby forming the heating chamber barrier layer 5 that defines an area for the formation of the heating chamber 4. This ends the first process.

Figure 9B:
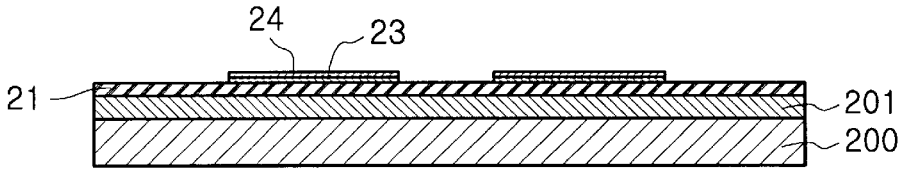
Figure 10A:
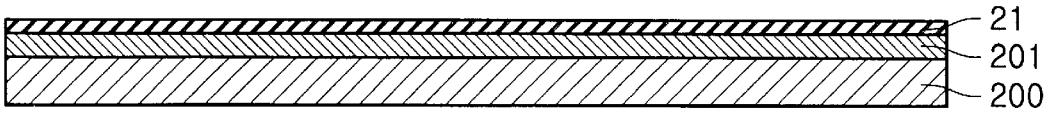
FIGS. 10*a* to 10*d* are cross-sectional views showing a process for manufacturing a membrane according to a third embodiment of the present invention.

Then, a second process for forming a membrane shown in FIG. 9*b* is performed. The second process will be explained in more detail with reference to FIGS. 10*a* to 10*d*. As shown in FIG. 10*a*, organic material, preferably polyimide, is deposited on a silicon-substrate 200 on which a protection film 201 made of $SiO_2$ is formed, thereby forming the organic film 21.

Preferably, the organic film 21 is deposited by a spin coating method in which the thickness of thin film can be easily controlled. Preferably, the organic film 21 is deposited to a thickness in the range of approximately 2 $\mu$m to 2.5 $\mu\mu$m.

Subsequently, the organic film 21 is heat-treated approximately two times, at temperatures of preferably, in the range of approximately 130° C. to 290° C., at regular intervals. As a result, the organic film 21 has an excellent toughness all over the surface, which allows the adhesion film 23 to be firmly fixed. More preferably, the heat treatment on the organic film 21 is performed at temperatures of approximately 150° C. and 280° C. respectively.

Figure 10B:
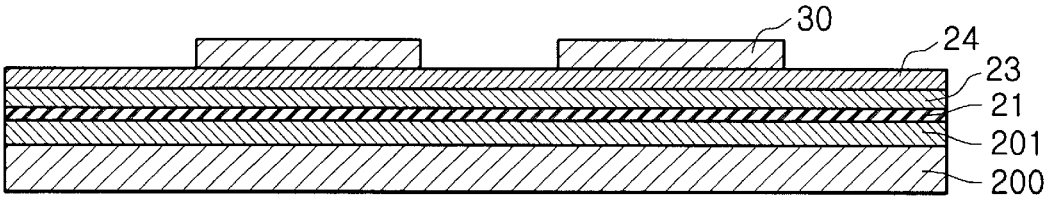
Figure 10C:
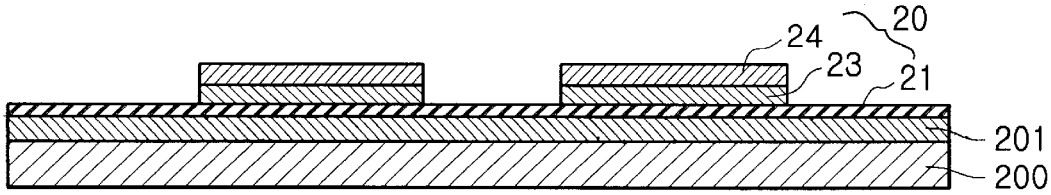
Figure 10D:
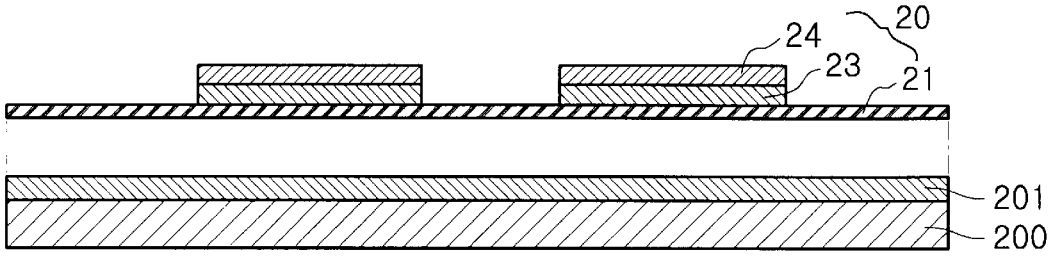

As shown in FIG. 10*b*, a metallic substance, preferably, vanadium, titanium, or chromium, etc., is deposited on the organic film 21 by a sputtering method, to thereby form the adhesion film 23. Preferably, the adhesion film 23 is formed to a thickness in the range of approximately 0.1 $\mu$m to 0.2 $\mu$m.

Subsequently, metallic material, preferably nickel, is deposited on the adhesion film 23 by a sputtering method, to thereby form the impact film 24. Preferably, the impact film 24 is formed to a thickness in the range of approximately 0.2 $\mu$m to 0.5 $\mu$m. Preferably, the impact film 24 is annealed at a temperature in the range of approximately 150° C. to 180° C. This annealing is for providing the impact film 24 with excellent toughness and mechanical tolerance.

Then, a pattern film 30 is formed partially on the surface of the impact film 24 so as to complete the impact film 24/adhesion film 23 structure. Subsequently, the impact film 24/adhesion film 23 is etched using the pattern film 30 as a mask, and the residual pattern film 30 is removed by chemicals. Thus, the organic film 21 is partially exposed so as to thereby complete the membrane 20 shown in FIG. 10*c*.

Figure 11A:
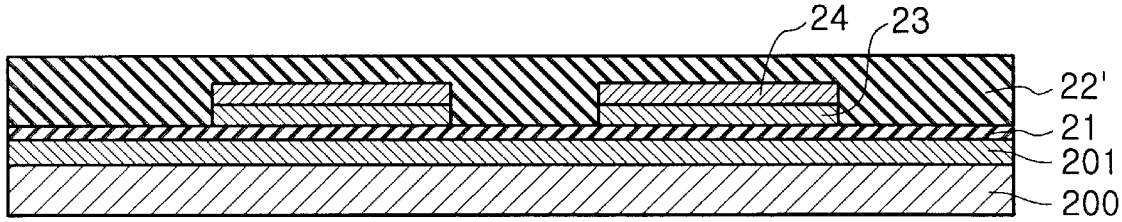
FIGS. 11*a* and 11*b* are cross-sectional views showing a process for manufacturing a membrane according to a fourth embodiment of the present invention.

As another embodiment of the first method for manufacturing an inkjet printhead of the present invention, a step for strengthening expansion and contraction of the organic film 21 can be added to the above-described step where the impact film 24/adhesion film 23 is etched to partially expose the organic film 21. In the added step, as shown in FIG. 11*a*, an organic substance, preferably, a polyimide 22' is deposited on the organic film 21 by a chemical vapor deposition method so as to thereby cover the impact film 24/adhesion film 23.

Figure 11B:
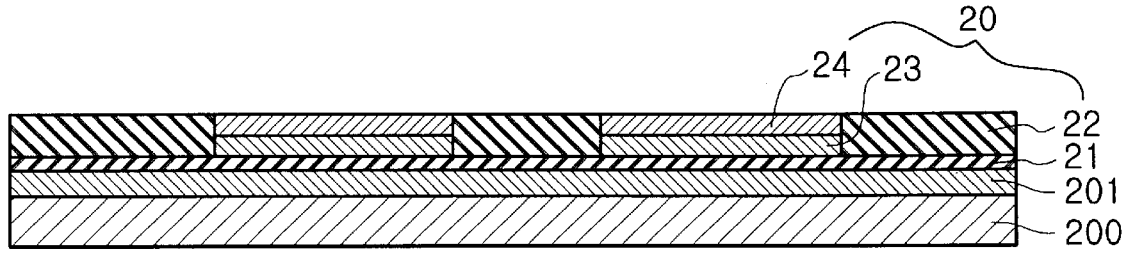

As shown in FIG. 11*b*, the polyimide 22' is etched back until a surface of the impact film 24 is exposed, to thereby complete the auxiliary organic film 22 that contacts both side surfaces of the impact film 24/adhesion film 23. The auxiliary organic film 22 so formed adheres firmly onto the organic film 21 so as to thereby improve the overall expansion and contraction of the membrane 20.

When the membrane 20 is completed through the processes explained above, as shown in FIG. 10*d*, the complete membrane 20 is stripped away from the substrate 200 on which the protection film 201 is formed, using chemicals, for example, hydrogen fluoride (HF). This ends the second process.

Figure 9C:
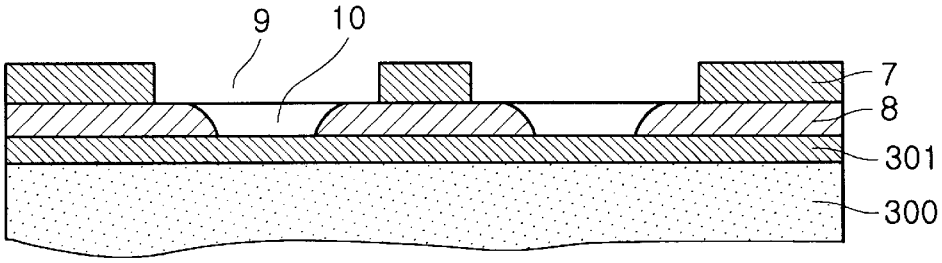

Now, a third process of the first method for manufacturing an inkjet printhead of the present invention will be explained. In the third process, as shown in FIG. 9*c*, metallic substance, for example, nickel, is deposited by electroplating method on a silicon-substrate 300 on which a protection film 301 made of $SiO_2$ is formed. Then, the nickel is etched using a pattern film so as to partial expose the protection film 301. Thus, the nozzle plate 8 is formed to define an area in which the nozzle 10 will be formed.

Subsequently, organic material, for example, polyimide, is deposited on the nozzle plate 8 so as to cover the protection film 301. Then, the polyimide is etched using a pattern film so as to partially expose the protection film 301 and the nozzle plate 8. Thus, the liquid chamber barrier layer 7 is formed to define an area in which the liquid chamber 9 will be formed.

When the nozzle plate 8/liquid chamber barrier layer 7 assembly is completed through the processes explained above, the complete nozzle plate 8/liquid chamber barrier layer 7 assembly is stripped away from the substrate 300 on which the protection film 301 is formed, using chemicals, for example, hydrogen fluoride (HF). Tis ends the third process.

When the above-described first to third processes are all completed, the assemblies manufactured in each process are then assembled to form a single assembly. That is, the membrane 20 formed through the second process is assembled onto the heating resistor layer 11/heating chamber barrier layer 5 assembly formed through the first process, and the nozzle plate 8/liquid chamber barrier layer 7 assembly formed through the third process is assembled onto the membrane. Here, the impact film 24/adhesion film 23 structure of the membrane 20 is aligned to the position where the heating resistor layer 11/heating chamber barrier layer 5 assembly is also positioned. The nozzle 10 in the nozzle plate 8/liquid chamber barrier layer 7 assembly is aligned to the position where the heating chamber 4 and the impact film 24/adhesion film 23 are also positioned.

The assemblies manufactured through the first to third processes are assembled to form a single assembly by the process of alignment and assembling. As a result, a complete inkjet printhead shown in FIG. 9*d* can be obtained.

Alternatively, an inkjet printhead of the present can be manufactured by a second method different from the above-described first one. As compared to the first method, the second method which will be explained hereinafter aligns at the same time a plurality of impact film 24/adhesion film 23 and a plurality of heating chambers to the same position.

In the second method, like the first one, the first process shown in FIG. 9a is performed. That is, the heating resistor layer 11 made of polysilicon is formed on the silicon-substrate 1 on which the protection film 2 made of $SiO_2$ is formed. Then, the electrode layer 3 made of aluminum is formed on both side surface of the heating resistor layer 11. Then, the heating chamber barrier layer 5 made of polyimide is formed on the electrode layer 3 that includes the heating resistor layer 11 so as to define an area in which the heating chamber 4 will be formed.

Then, second and third processes for forming a membrane will be performed. Different from those of the first method, the second and third processes for manufacturing a membrane are as follows. The organic film 21 having no impact film/adhesion film is assembled to the heating resistor layer 11/heating chamber barrier layer 5 assembly, and the impact film 24/adhesion film 23 is formed on the assembled organic film 21

Figure 12A:
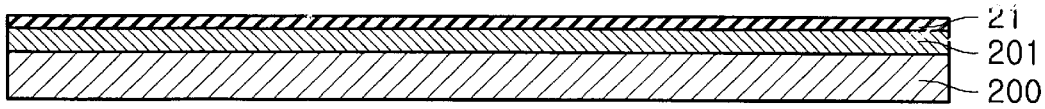
FIGS. 12*a* to 12*e* are cross-sectional views showing a process for manufacturing a membrane according to a fifth embodiment of the present invention.

The second and third processes of the second method will be explained in more detail with reference to FIG. 12*a* to FIG. 12*e*. As shown in FIG. 12*a*, organic material preferably polyimide, is deposited on the silicon-substrate 200 on which the protection film 201 made of $SiO_2$ is formed, to thereby form the organic film 21.

Preferably, the organic film 21 is deposited by a spin coating method in which the thickness of thin film can be easily controlled. Preferably, the thickness of the organic film 21 is in the range of approximately 2 $\mu$m to 2.5 $\mu$m.

Then, the organic film 21 is heat-treated approximately two times, preferably at temperatures in the range of approximately 130° C. to 290° C., at regular intervals. As a result, the organic film 21 has an excellent toughness over the entire surface, which allows the adhesion film 23 to be firmly fixed. Preferably, the heat treatment on the organic film 21 is performed two times at temperatures of approximately 150° C. and 280° C., respectively.

Figure 12B:
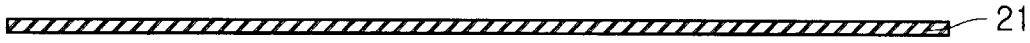

As shown in FIG. 12*b*, using chemicals, for example, hydrogen fluoride, the complete organic film 21 is stripped away from the substrate 200 on which the protection film 201 is formed. Then, the organic film 21 so stripped is assembled to the heating resistor layer 11/heating chamber barrier layer 5 assembly which is completed through the first process.

Figure 12C:
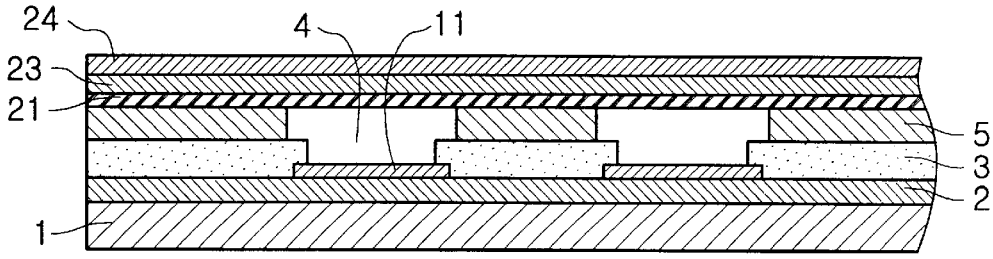

Subsequently, as shown in FIG. 12*c*, metallic material, preferably, vanadium, titanium, or chromium, etc., is deposited by a sputtering method on the organic film 21 assembled onto the heating resistor layer 11/heating chamber barrier layer 5 assembly, to thereby form the adhesion film 23. Preferably, the thickness of the adhesion film 23 is in the range of approximately 0.1 $\mu$m to 0.2 $\mu$m.

Subsequently, metallic material preferably, nickel is deposited on the adhesion film 23 by a sputtering method, to thereby form the impact film 24. Preferably, similarly to the first method, the thickness of the impact film 24 is in the range of approximately 0.2 $\mu$m to 0.5 $\mu$m. Preferably, the impact film 24 is annealed at a temperature in the range of approximately 150° C. to 180° C. so that the impact film 24 can have excellent toughness and mechanical tolerance.

Figure 12D:
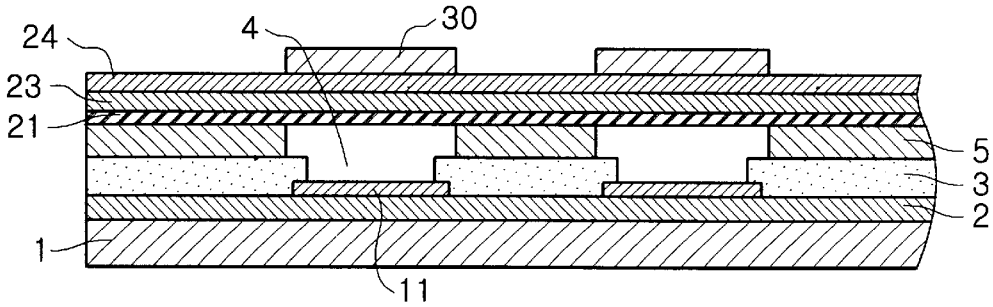
Figure 12E:
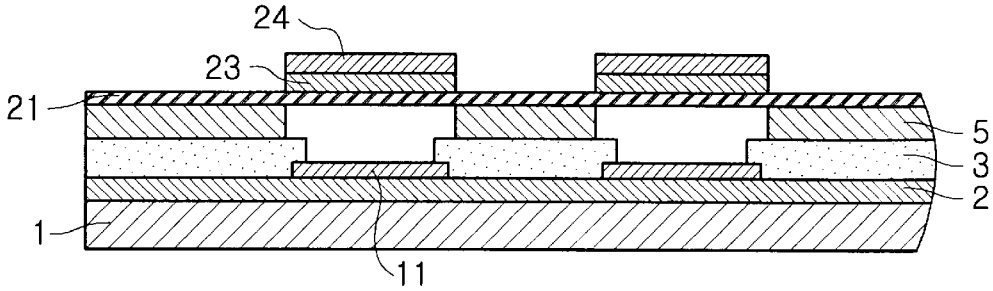

To complete the impact film 24/adhesion film 23 structure, as shown in FIG. 12*d*, a pattern film 30 is partially formed on the impact film 24, and the impact film 24/adhesion film 23 is etched using the pattern film 30 as a mask. Then the residual pattern film 30 is removed by chemicals so that the organic film 21 can be partially exposed. As a result, the membrane having a complete structure shown in FIG. 12*e* can be obtained. Here, the impact film 24/adhesion film 23 is formed is at a position which corresponds to that where the heating chamber 4 is formed.

As described above, in the second method of the present invention, the organic film 21 is assembled onto the heating chamber 4 prior to the formation of impact film 24/adhesion film 23 structure of which position corresponds to that of the heating chamber 4. Thus, differently from the first method, when the membrane 20 is assembled onto the heating resistor layer 11/heating chamber barrier layer 5 assembly, an additional process for aligning each by each a plurality of impact film 24/adhesion film 23 and a plurality of heating chamber 4 to the relevant position can be omitted. As a result, the efficiency of the overall manufacturing process can be significantly improved.

As another embodiment of the second method, similarly to the first method, a step for forming the auxiliary organic film 22 for strengthening expansion/contraction of the organic film 21 can be added to the step of etching the impact film 24/adhesion film 23 to partially expose the organic film 21. The auxiliary organic film 22 thus formed contacts both side surfaces of the impact film 24/adhesion film 23, and is firmly adhered onto the organic film 21, to thereby serve to promote overall expansion and contraction of the membrane 20.

Subsequently, a fourth process of the second method is performed. In the fourth process, similarly to the first method, the process as shown in FIG. 9*c* is performed. The nozzle plate 8 made of nickel is formed on the silicon-substrate 300 on which the protection film 301 made of $SiO_2$, etc., is formed, so as to define an area where the nozzle 10 will be formed. Then, the liquid chamber barrier layer 7 made of polyimide is formed on the nozzle plate 8 so as to define an area where the liquid chamber 9 will be formed.

When the nozzle plate 8/liquid chamber barrier layer 7 assembly is completed through the above-described processes, the nozzle plate 8/liquid chamber barrier layer 7 assembly is stripped away from the substrate 300 on which the protection film 301 is formed, using chemicals, for example, hydrogen fluoride. This ends the fourth process.

When the above-described first to fourth processes are completed, the assemblies manufactured by each process are assembled to form a single assembly. In the second method, as described above, the membrane 20 is assembled onto the heating resistor layer 12/heating chamber barrier layer 5 assembly through the second and third processes, prior to assembling the parts as a single assembly. Then, all that remains is assembling the nozzle plate 8/liquid chamber barrier layer 7 assembly onto the membrane. Accordingly, the yield of an overall manufacturing process can be significantly improved.

Figure 9D:
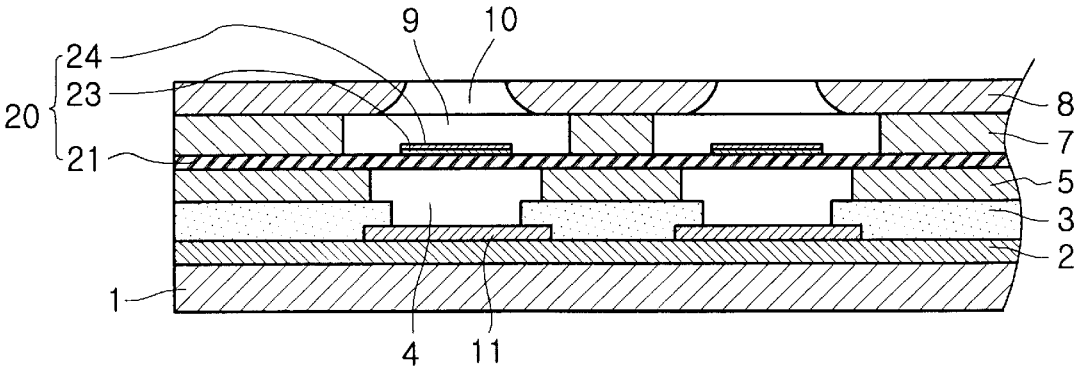

In this case, the nozzle 10 in the nozzle plate 8/liquid chamber barrier layer 7 assembly is aligned to the position which corresponds to those where the heating chamber 4 and the impact film 24/adhesion film 23 are formed. Each structure completed through the first to fourth processes is assembled to a single assembly through process of alignment and assembling. Thus, an inkjet printhead having a complete structure as shown in FIG. 9*d* can be obtained.

In the present invention, a membrane consists of two films: an impact film for delivering expansion and an organic film for dispersing and removing a stress on the impact film. Thus, prevention of the deformation of a main operation part of the membrane can be obtained. In addition, the main operational part of the membrane can be provided with an enhanced performance characteristic. As a result, overall performance of an inkjet printhead can be greatly improved.

As described above, the present invention is characterized in that a main operation part of a membrane is structured to have two regions: an impact film region having high restoring force characteristics, for example, a nickel film region, and an organic film region having a high expansion and contraction, for example, a polyimide film region. The above two regions serve as an impact delivery medium for strongly pushing ink upward, a prompt initialization medium, and a hinge for dispersing and eliminating a stress, to thereby prevent deformation, for example, wrinkling, of the a membrane. In addition, a membrane having such enhanced main operation part can endure stress and react well during operation. As a result, a significantly enhanced printing performance can be obtained.

This invention has been described above with reference to the aforementioned embodiments. It is evident, however, that many alternative modifications and variations will be apparent to those having skill in the art in light of the foregoing description. Accordingly, the present invention embraces all such alternative modifications and variations as fall within the spirit and scope of the appended claims.

What is claimed is:

1. A micro-injecting device, comprising:

a substrate;

a protection film formed on said substrate;

a heating resistor layer formed on a portion of said protection film, for heating a heating chamber;

an electrode layer formed on said protection film and which contacts said heating resistor layer, for transmitting an electric signal to said heating resistor layer;

a heating chamber barrier layer formed on said electrode layer and defining a heating chamber enclosing said heating resistor layer, said heating chamber having an axis, said heating chamber for holding a working liquid;

a membrane formed on the heating chamber barrier layer for transmitting volume changes of the liquid in the heating chamber, said membrane comprising:

an organic film formed over an entire heating chamber barrier layer and covering the heating chamber; and an impact film formed on a portion of said organic film, said impact film centered on an axis of the heating chamber;

a liquid chamber barrier layer formed on a portion of the membrane and defining a liquid chamber, said liquid chamber being coaxial with said heating chamber and a center of said impact film; and a nozzle plate formed on said liquid chamber barrier layer, said nozzle plate having a nozzle coaxial with said liquid chamber.

2. The micro-injecting device of claim 1, further comprising:

an adhesion film of different material than the organic film and the impact film, said adhesion film disposed between the organic film and the impact film on a same portion of the organic film as the impact film, said adhesion film for improving the adhesion of the impact film to the organic film.

3. The micro-injecting device of claim 2, further comprising:

said adhesion film being formed of vanadium, titanium or chromium.

4. The micro-injecting device of claim 2, further comprising:

said adhesion film being having a thickness in the range of approximately 0.1 to 0.2 $\mu$m.

5. The micro-injection device of claim 1, further comprising:

said organic film formed of polyimide.

6. The micro-injecting device of claim 1, further comprising:

said impact film being formed of nickel.

7. The micro-injecting device of claim 1, further comprising:

said organic film having a thickness in the range of approximately 2.0 to 2.5 $\mu$m.

8. The micro-injecting device of claim 1, further comprising:

said impact film having a thickness in the range of approximately 0.2 to 0.5 $\mu$m.

9. The apparatus of claim 1, wherein said apparatus is manufactured by a process comprising the steps of:

forming a heating chamber barrier layer assembly by the steps of:

forming said heating resistor layer on said protection film on said substrate;

forming said electrode layer contacting said heating resistor layer; and forming said heating chamber barrier layer, defining a heating chamber, on the heating resistor layer;

forming said membrane by the steps of:

depositing said organic film on a second protection film on a second substrate;

heat-treating the organic film;

depositing an adhesion film of different material from the organic film on the organic film;

depositing said impact film of different material from the adhesion film on the adhesion film;

etching the adhesion film and the impact film to partially expose the organic film; and stripping the deposited and etched films as a membrane from the second substrate;

forming said nozzle plate and said liquid chamber barrier layer by the steps of:

forming said nozzle plate on a third protection film on a third substrate;

forming said liquid chamber barrier layer, defining a liquid chamber, on said nozzle plate; and stripping the nozzle plate and liquid chamber barrier layer from the third substrate; and assembling the micro-injector by the steps of:

attaching the stripped membrane to the heating chamber barrier layer assembly with the organic film contacting the heating chamber barrier layer and with the impact film aligned with the heating chamber to form a first assembly; and attaching the nozzle plate and liquid chamber barrier layer assembly to the first assembly with the liquid chamber barrier layer on the membrane and with the liquid chamber aligned coaxially with the heating chamber.

10. The apparatus of claim 1, wherein said apparatus is manufactured by a process comprising the steps of:

forming said heat chamber barrier layer assembly by the steps of:

forming said heating resistor layer on said protection film on said substrate;

forming said electrode layer contacting the heating resistor layer; and forming said heating chamber barrier layer, defining a heating chamber, on the heating resistor layer;

forming an organic film by the steps of:

depositing an organic film on a second protection film of a second substrate;

heat-treating the organic film; and stripping said organic film from said second substrate and said second protection film;

forming a first assembly by the steps of:

attaching said stripped organic film to said heat chamber barrier layer assembly;

depositing an adhesion film of different material than the organic film on the attached organic film;

depositing said impact film of different material from the adhesion film on the adhesion film; and etching the adhesion film and the impact film to partially expose the organic film and to leave an adhesion film/impact film section aligned with the heating chamber;

forming a nozzle plate and liquid chamber barrier layer assembly by the steps of:

forming said nozzle plate on a third protection film on a third substrate;

forming said liquid chamber barrier layer, defining said liquid chamber, on said nozzle plate; and stripping the nozzle plate and liquid chamber barrier layer assembly from the third substrate and said third protection film; and attaching said nozzle plate and liquid chamber barrier layer assembly to the upper surface of said first assembly with the liquid chamber coaxial with the heating chamber.

11. A micro-injecting device, comprising:

a substrate;

a protection film formed on said substrate;

a heating resistor layer formed on a portion of said protection film, for heating a heating chamber;

an electrode layer formed on said protection film and which contacts said heating resistor layer, for transmitting an electric signal to said heating resistor layer;

a heating chamber barrier layer formed on said electrode layer and defining a heating chamber enclosing said heating resistor layer, said heating chamber having an axis, said heating chamber for holding a working liquid;

a membrane formed on the heating chamber barrier layer for transmitting volume changes of the liquid in the heating chamber, said membrane comprising:

an organic film formed over an entire heating chamber barrier layer and covering the heating chamber; and an impact film formed on a portion of said organic film, said impact film centered on an axis of the heating chamber;

a liquid chamber barrier layer formed on a portion of the membrane and defining a liquid chamber, said liquid chamber being coaxial with said heating chamber and a center of said impact film; and a nozzle plate formed on said liquid chamber barrier layer, said nozzle plate having a nozzle coaxial with said liquid chamber, said membrane further comprising:

an auxiliary organic film formed of a same material as said organic film, said auxiliary organic film being formed on a portion of the organic film overlapping an upper edge of the heating chamber, a side surface of the auxiliary organic film contacting a side surface of said impact film, and said auxiliary organic film disposed between said organic film and said liquid chamber barrier layer.

12. The micro-injecting device of claim 11, further comprising:

an adhesion film of different material than the organic film and the impact film, said adhesion film disposed between the organic film and the impact film on same portion of the organic film as the impact film, said adhesion film for improving the adhesion of the impact film to the organic film.

13. The micro-injecting device 12, further comprising:

said adhesion film being formed of vanadium, titanium or chromium.

14. The micro-injecting device of claim 12, further comprising:

said adhesion film being having a thickness in the range of approximately 0.1 to 0.2 $\mu$m.

15. The micro-injecting device of claim 11, further comprising:

said organic film being formed of polyimide.

16. The micro-injecting device of claim 11, further comprising:

said impact film being formed of nickel.

17. The micro-injecting device of claim 11, further comprising:

said organic film having a thickness in the range of approximately 2.0 to 2.5 $\mu$m.

18. The micro-injecting device of claim 11, further comprising:

said impact film having a thickness in the range of approximately 0.2 to 0.5 $\mu$m.

* * * * *